US008678988B2

(12) United States Patent
Lahmann

(10) Patent No.: US 8,678,988 B2
(45) Date of Patent: Mar. 25, 2014

(54) CENTRIFUGE OPENING TOOL

(76) Inventor: Thomas Lahmann, Denver, IA (US)

( * ) Notice: Subject to any disclaimer, the term of this patent is extended or adjusted under 35 U.S.C. 154(b) by 322 days.

(21) Appl. No.: 13/278,302

(22) Filed: Oct. 21, 2011

(65) Prior Publication Data

US 2012/0100980 A1 Apr. 26, 2012

Related U.S. Application Data

(60) Provisional application No. 61/405,430, filed on Oct. 21, 2010.

(51) Int. Cl.
*B04B 15/00* (2006.01)
*B67B 7/12* (2006.01)

(52) U.S. Cl.
USPC ..... 494/64; 494/85; 81/3.31; 81/3.33

(58) Field of Classification Search
USPC ..... 494/12, 64, 85; 81/3.31, 3.33, 3.36
See application file for complete search history.

(56) References Cited

U.S. PATENT DOCUMENTS

| | | | | | |
|---|---|---|---|---|---|
| 620,366 | A * | 2/1899 | Salenius | 29/279 |
| 1,431,923 | A * | 10/1922 | Baughman | 81/3.39 |
| 1,894,556 | A * | 1/1933 | Edlund | 81/3.42 |
| 5,344,380 | A * | 9/1994 | Chern et al. | 494/12 |
| 6,148,692 | A * | 11/2000 | Russell | 81/3.2 |
| 2012/0100980 | A1 * | 4/2012 | Lahmann | 494/41 |

FOREIGN PATENT DOCUMENTS

| | | | | |
|---|---|---|---|---|
| DE | 3302115 | A1 * | 7/1984 | B04B 7/12 |
| JP | 07328487 | A * | 12/1995 | B04B 15/00 |

* cited by examiner

*Primary Examiner* — Charles E Cooley
(74) *Attorney, Agent, or Firm* — Patwrite Law; Mark David Torche

(57) ABSTRACT

A centrifuge opening tool has a frame that securely holds a centrifuge drum therein. An upright tube is mounted to the frame and a brake band is rotatably secured to the upright tube. When the brake band is tightened, the centrifuge drum is securely held in place. A ring gear is secured to a lock ring. The lock ring is part of the centrifuge drum and is removable to allow access to the interior therein. A drive gear meshes with the ring gear and increases the mechanical advantage allowing a user to apply the force needed to open the lock ring even when it has been extremely compressed. A spanner wrench is placed on a drive shaft that is connected to the drive gear. Engagement pins are used to mechanically couple the gear ring and lock ring together.

18 Claims, 6 Drawing Sheets

CENTRIFUGE OPENING TOOL

CROSS REFERENCE TO RELATED APPLICATIONS

This application claims priority and herein incorporates by reference U.S. provisional patent application 61/405,430, filed Oct. 21, 2010.

BACKGROUND OF THE INVENTION

The development of the centrifuge as a tool to process materials is well known and fundamental to our society and the production of materials necessary for modern life. Centrifuges are used in almost every field of endeavor from isotope separation, human testing, earthquake simulation, biological and food processes, waste treatment, and oil treatment just to name a few.

As the centrifuge spins, tremendous forces are generated which tends to compress and tighten the threads holding the centrifuge access door in place and may make opening extremely difficult. There is a need for a tool that allows opening of a centrifuge with relative ease.

SUMMARY OF THE INVENTION

A centrifuge opening tool has a frame that securely holds a centrifuge drum therein. An upright tube is mounted to the frame and a brake band is rotatably secured to the upright tube. When the brake band is tightened, the centrifuge drum is securely held in place. A ring gear is secured to a lock ring. The lock ring is part of the centrifuge drum and is removable to allow access to the interior therein. A drive gear meshes with the ring gear and increases the mechanical advantage allowing a user to apply the force needed to open the lock ring even when it has been extremely compressed. A spanner wrench is placed on a drive shaft that is connected to the drive gear. Engagement pins are used to mechanically couple the gear ring and lock ring together.

Other features and advantages of the instant invention will become apparent from the following description of the invention which refers to the accompanying drawings.

DETAILED DESCRIPTION OF THE INVENTION

Figure 1:
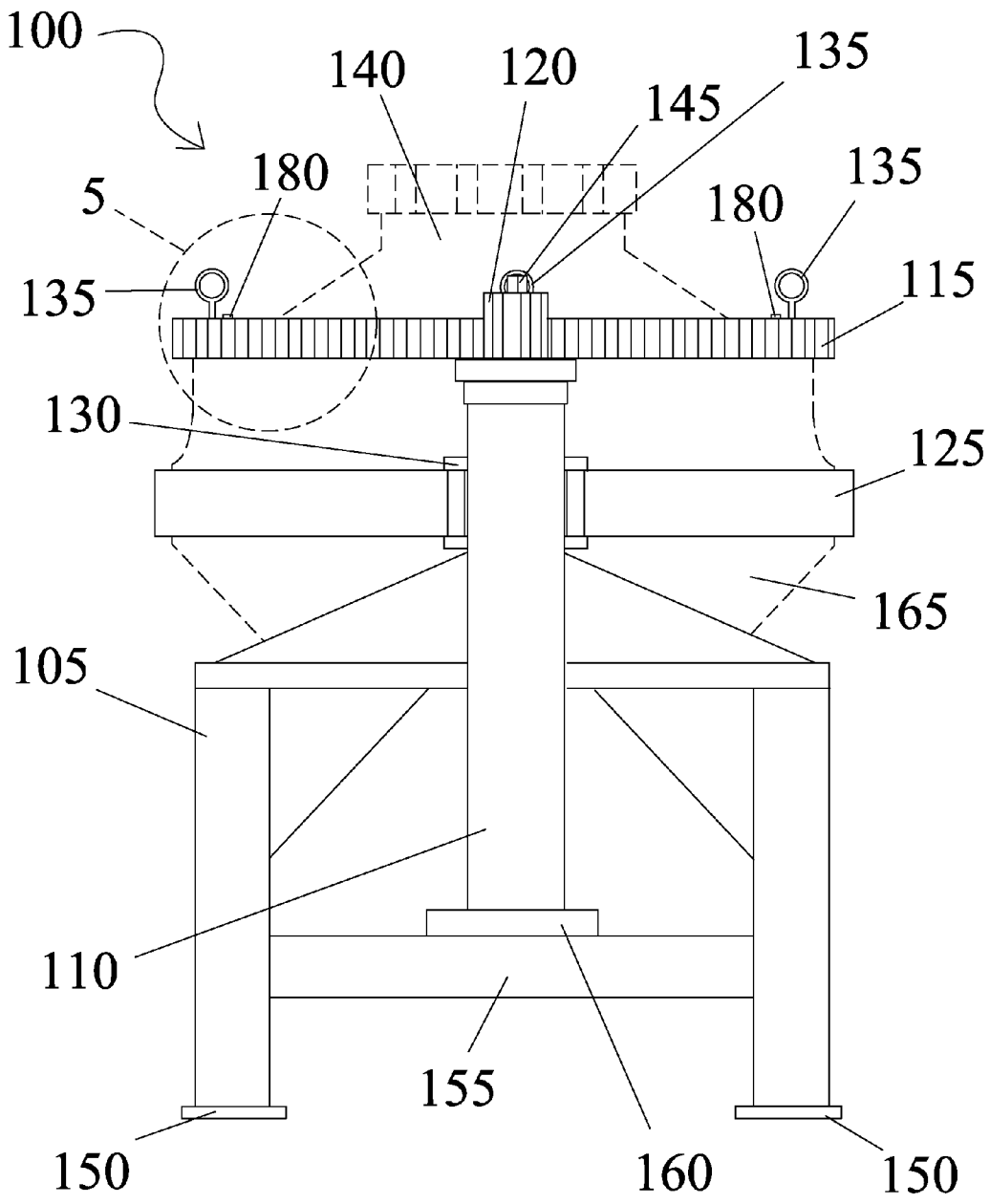
FIG. 1 is a rear side view of a centrifuge opening tool according to an embodiment of the invention.

In the following detailed description of the invention, reference is made to the drawings in which reference numerals refer to like elements, and which are intended to show by way of illustration specific embodiments in which the invention may be practiced. It is understood that other embodiments may be utilized and that structural changes may be made without departing from the scope and spirit of the invention.

Figure 2:
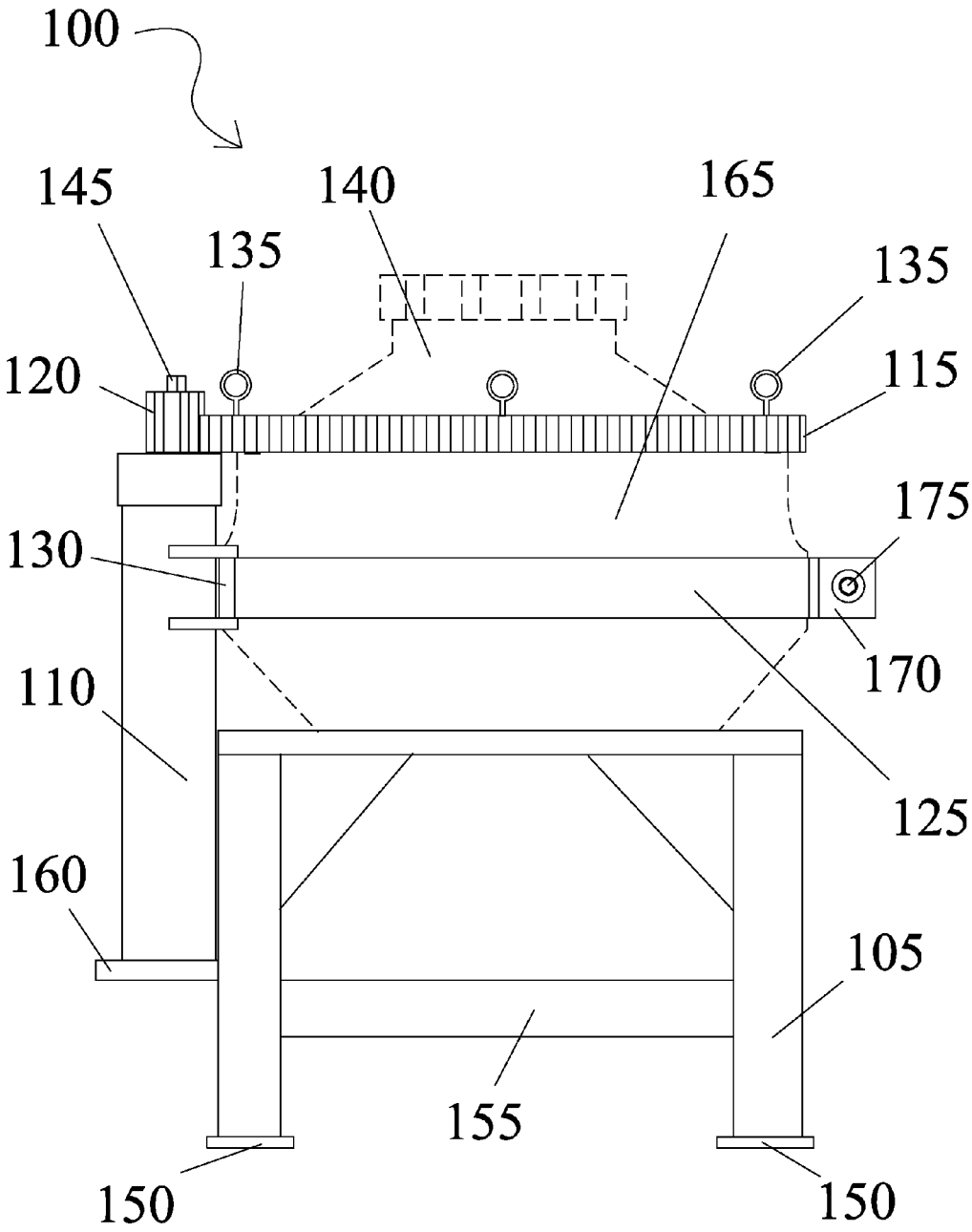
FIG. 2 is a side view of the centrifuge opening tool shown in FIG. 1.
Figure 3:
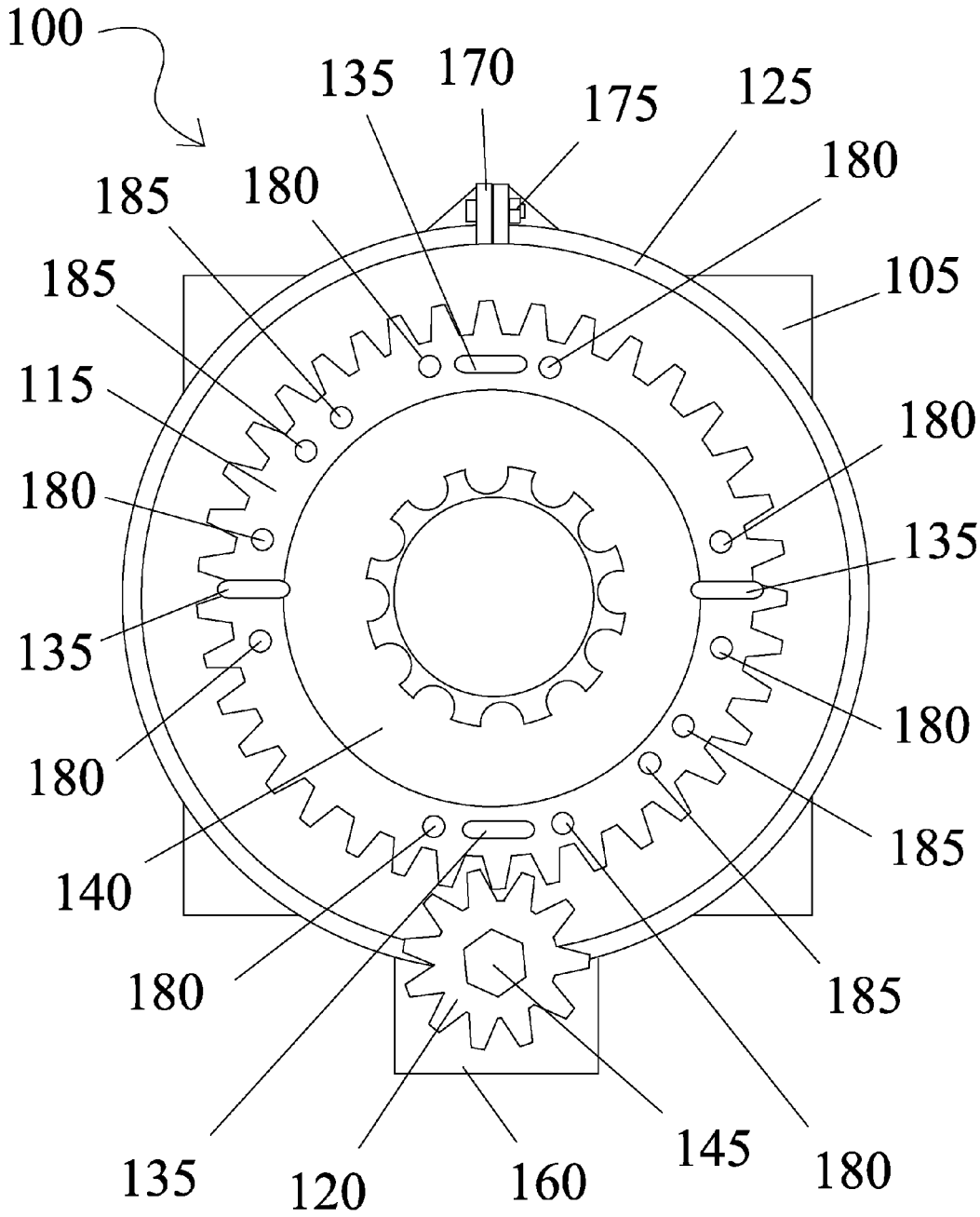
FIG. 3 is a top view of the centrifuge opening tool shown in FIG. 1.
Figure 4:
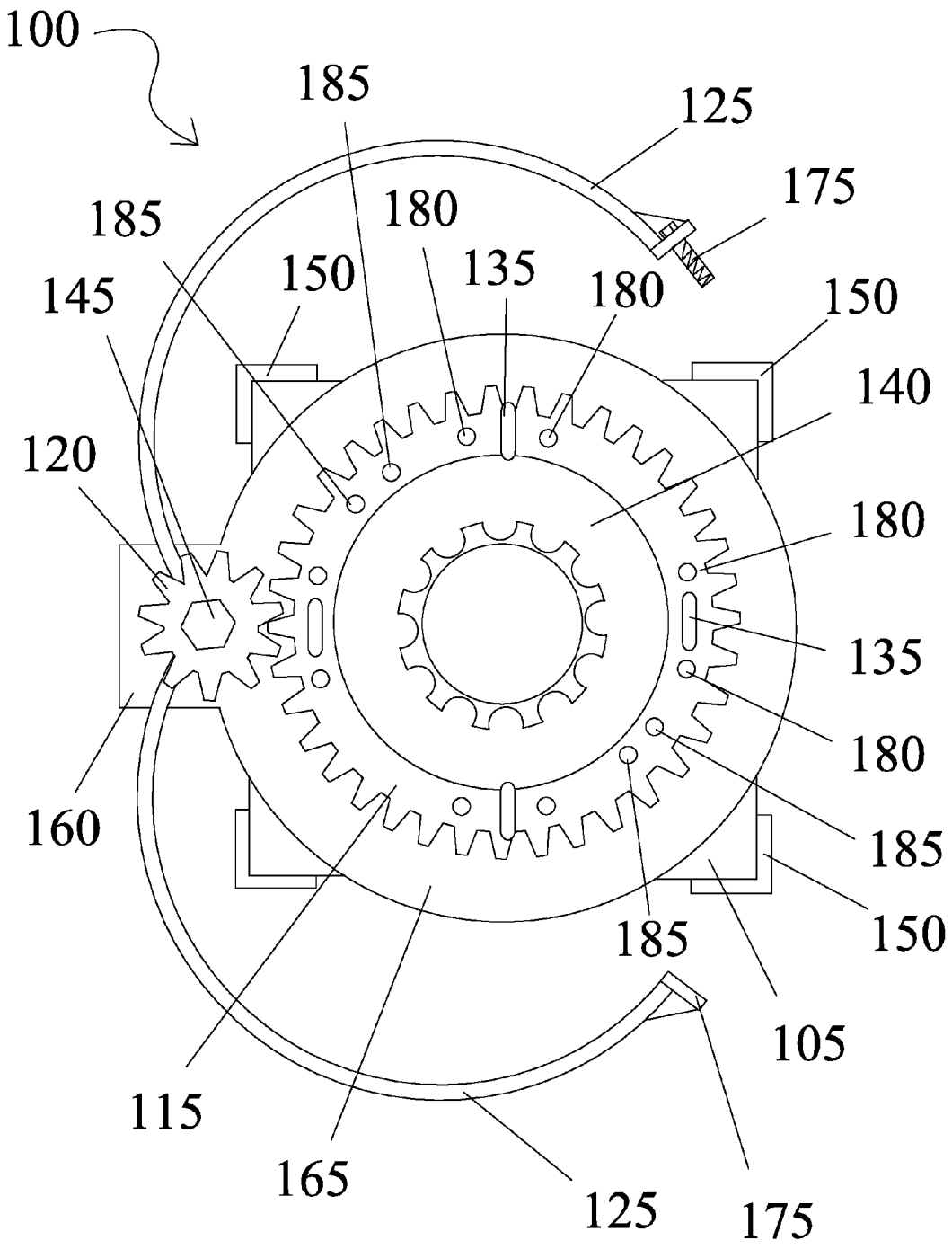
FIG. 4 is a top view of the centrifuge opening tool shown in FIG. 1 with the brake band in an open position.

Referring to FIGS. 1 through 4, a centrifuge opening tool 100 is shown having a frame 105 that supports a centrifuge drum 165. A brake band 125 is made of two parts—left and right side—that is hinged using brake band holders 130 and is mounted on both sides of an upright tube 110 that is securely attached to frame 105 and secured to a tube plate 160. Frame 105 has four legs with four feet pads 150 and cross braces 155. Gussets are used to stiffen and strengthen frame 105. Brake band 125 is moved to an open position allowing centrifuge drum to be placed therein. After placing centrifuge drum 165 on frame 105, brake band 125 is closed and a bolt 175 is used to compress and tighten brake band 125 by tightening a brake band compression bracket 170. This securely holds centrifuge 165 and prevents rotation.

Figure 5:
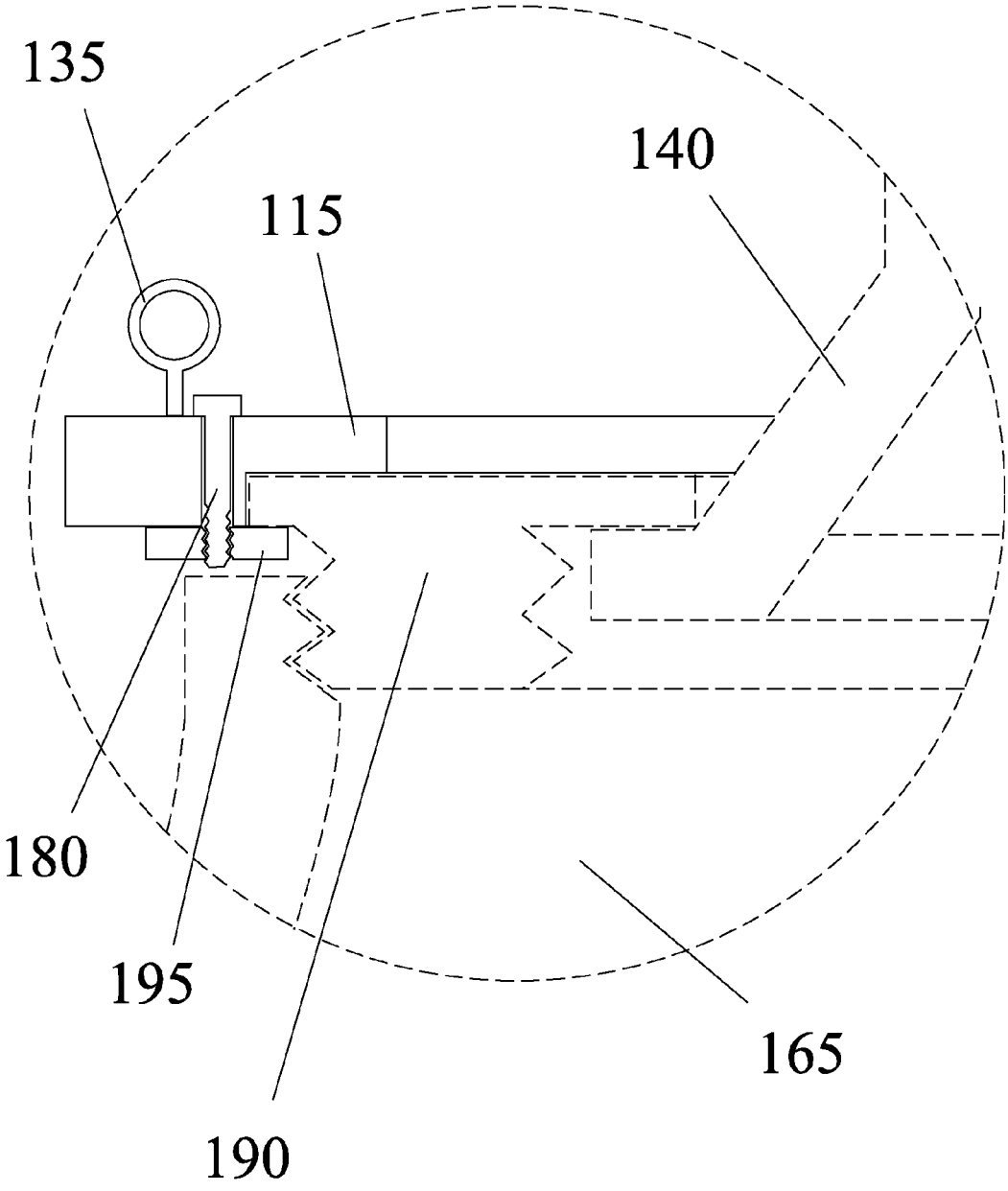
FIG. 5 is a detail cutaway view of the portion shown in figure 1.
Figure 6:
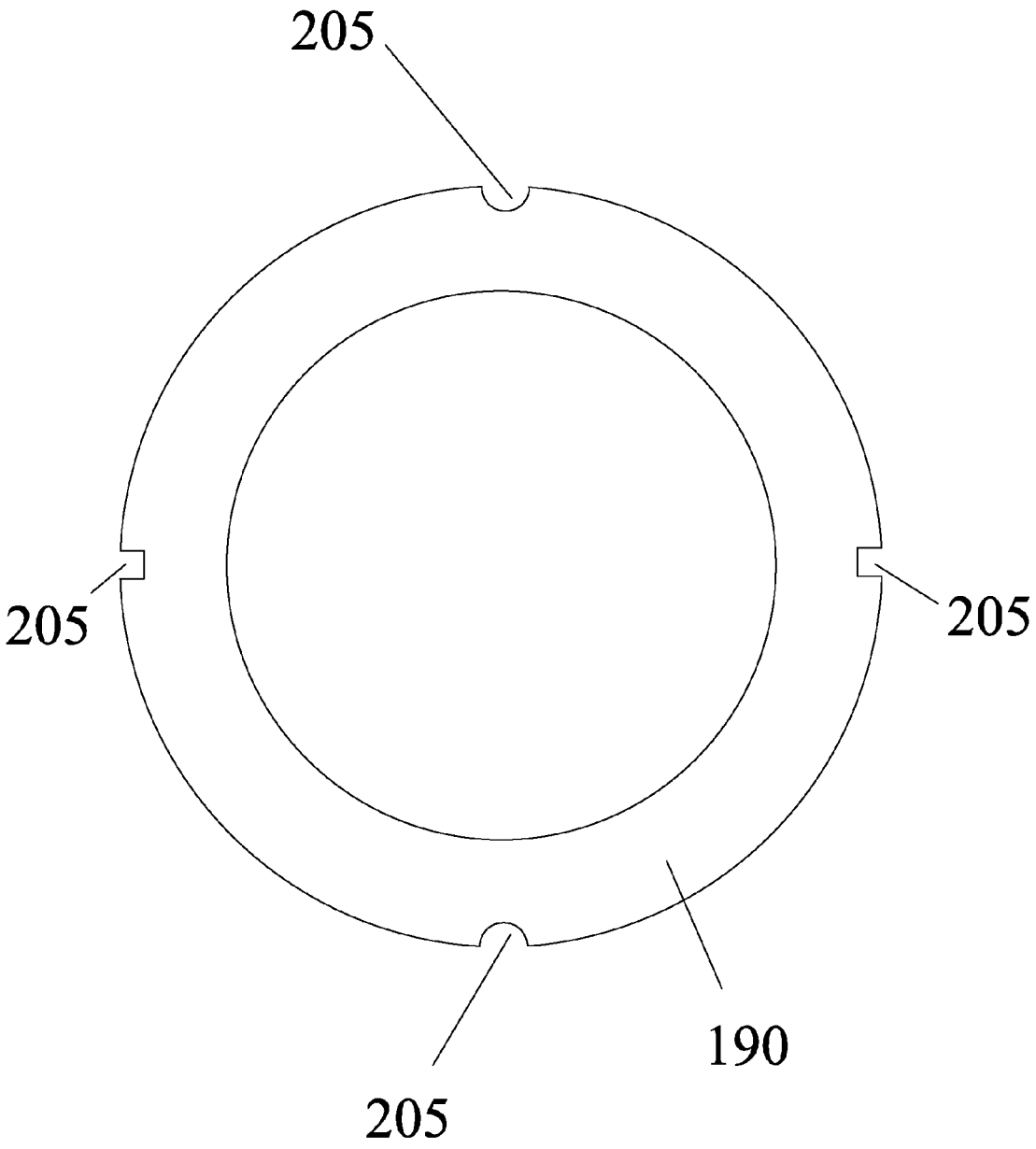
FIG. 6 is a top view of the lock ring shown in FIG. 5.

Now referring to FIGS. 1 through 6, a ring gear 115 is placed over a lock ring 190. Lock ring 190 is part of centrifuge 165 and is used to securely hold a centrifuge cover 140 in place sealing the contents therein. Lock ring 190 has four notches 205 that are used to turn lock ring 190. To hold ring gear 115 securely to lock ring 190, a number of engagement bolts 180 are used by fitting a lock retaining plate 195 beneath a lip formed on lock ring 190 and then tightening. Lock retaining plate 195 is tapped to match the threads on engagement bolts 180.

A number of engagement pins 185 are placed in matched openings in ring gear 115 which align with lock ring notches 205 and are used to turn lock ring 190 when ring gear 115 is turned. As shown, two notches 205 are shown with square openings and two with circular openings. Of course other geometries are possible as long as rotation force may be applied by inserting a matching pin therein. A mechanically advantaged drive gear 120 meshes with ring gear 115 as allows a user to rotate ring gear 115. A drive shaft 145 is formed on top of drive gear 120 and allows a user to place a spanner or other tool (not shown) to rotate drive gear 120. Additionally, a motorized driver or other mechanical device such as a pneumatic driver could be used to engage drive gear 120.

Because of the mechanical advantage afforded by the gear ratio between drive gear 120 and ring gear 115, a much greater force may be applied to lock ring 190 than would be possible by applying a similar force to lock ring notch 205 directly.

Four eye bolts 135 are used to hold, manipulate and position ring gear 115. Once lock ring 190 is unscrewed and free of centrifuge 165 it may be manipulated using eye bolts 135 while it remains attached to ring gear 115. A four part chain sling is used to manipulate ring gear 115 and attached lock ring 190. Of course other kinds of assists may be used such as overhead crane, block and tackle, hydraulic lift, etc. Once lock ring 190 is removed, centrifuge cover 140 is removed allowing access to the interior of centrifuge 165. This allows relatively easy access even when lock ring 190 is extremely compressed when conventional means of opening would be extremely difficult.

Although the instant invention has been described in relation to particular embodiments thereof, many other variations and modifications and other uses will become apparent to those skilled in the art.

What is claimed is:

1. A centrifuge opening tool comprises:

a frame;

said frame adapted to hold a centrifuge drum;

a centrifuge cover adapted to removably seal said centrifuge drum;

said centrifuge drum having a removable lock ring;

said lock ring being adapted to hold said centrifuge cover in place when sealed;

a centrifuge drum holding means for holding said centrifuge drum securely therein;

a ring gear;

said ring gear being adapted to be removably secured to said lock ring; and a drive gear adapted to rotatably engage with said ring gear wherein said drive gear is selected to increase a mechanical advantage between said drive gear and said ring gear.

2. The centrifuge opening tool according to claim 1 wherein said centrifuge drum holding securing means is a brake band hingedly attached to said frame; said brake band having a compression bracket removably secured with a bolt whereby said centrifuge drum is removably secured to said centrifuge frame.

3. The centrifuge opening tool according to claim 1 further comprising a plurality of lifting bolts attached along a periphery of said ring gear whereby said ring gear is selectively attachably to a lifting means for positioning said ring gear.

4. The centrifuge opening tool according to claim 3 whereby said lifting means is a hoist.

5. A centrifuge opening tool comprising:

a frame;

said frame having an upright tube along a back side;

a brake band hingedly attached to said upright tube;

said brake band adapted to removably secure a centrifuge therein;

said centrifuge having a drum portion and a removable top;

said removable top being secured to said drum portion by a lock ring;

a ring gear adapted to be removably attached to said lock ring;

said ring gear having an outer perimeter defining a geared portion;

a drive gear rotatably disposed within an upper portion of said upright tube; and said drive gear having a drive gear portion adapted to mesh with said geared portion of said ring gear wherein a gear ratio between said geared portion and said drive gear portion is selected to increase a mechanical advantage force applied to said lock ring.

6. The centrifuge opening tool according to claim 5 further comprising a drive shaft fixedly attached to said drive gear whereby a drive shaft turning means for turning said drive gear is selectively adapted to turn said drive gear.

7. The centrifuge opening tool according to claim 6 whereby said drive shaft turning means is a spanner wrench.

8. The centrifuge opening tool according to claim 6 whereby said drive shaft turning means is powered driver.

9. The centrifuge opening tool according to claim 5 wherein said frame has four legs with a foot disposed at a bottom of each leg.

10. The centrifuge opening tool according to claim 9 further comprising a plurality of lifting bolts attached to said ring gear whereby said ring gear is removably attachable to a hoist.

11. The centrifuge opening tool according to claim 5 wherein said brake band has a left side and a right side.

12. The centrifuge opening tool according to claim 11 further comprising a brake band holder left side and a brake band holder right side; said left side and said right side having a flange portion defining a bolt opening therein; a bolt removably fitting within said bolt openings whereby said drum portion is securely held therein when said bolt is tightened.

13. A centrifuge opening tool comprising:

a frame having four legs;

an upright tube fixedly disposed along a back portion of said frame;

said upright tube having a drive gear rotatably disposed on a top portion of said upright tube;

a left and right brake band hingedly disposed on a portion of said upright tube;

said left and right brake band having a compression bracket disposed on an open end;

a securing means for selectively securing a centrifuge drum therein;

a ring gear adapted to fit against a lock ring;

said lock ring removably securing a centrifuge cover to said centrifuge drum;

said ring gear having an outer periphery defining a gear portion; and said gear portion adapted to mesh with said drive gear.

14. The centrifuge opening tool according to claim 13 wherein said lock ring has a plurality of notches therein.

15. The centrifuge opening tool according to claim 14 further comprising a plurality of engagement pins selectively disposed within said plurality of notches whereby said lock ring is selectively locked in place.

16. The centrifuge opening tool according to claim 14 further comprising:

a plurality of engagement holes disposed along a periphery of said ring gear;

a plurality of lock ring retaining plates; and a plurality of engagement bolts adapted to fit within said plurality of engagement holes and said plurality of lock ring retaining plates and secured with a plurality of nuts whereby said gear ring is removably attached to said lock ring.

17. The centrifuge opening tool according to claim 16 further comprising a plurality of lifting bolts attached to said ring gear whereby said ring gear is supportable thereby.

18. The centrifuge opening tool according to claim 13 whereby said drive gear having a spanner nut disposed on a top portion adapted to accept a matching spanner wrench whereby a force may be applied thereby.

* * * * *